United States Patent [19]

Aoki

[11] 4,419,916

[45] Dec. 13, 1983

[54] ELECTRONIC MUSICAL INSTRUMENT EMPLOYING KEYBOARD TONALITY DESIGNATION SYSTEM

[75] Inventor: Eiichiro Aoki, Hamamatsu, Japan

[73] Assignee: Nippon Gakki Seizo Kabushiki Kaisha, Hamamatsu, Japan

[21] Appl. No.: 348,673

[22] Filed: Feb. 16, 1982

[30] Foreign Application Priority Data

Feb. 18, 1981 [JP] Japan ..... 56-22407

[51] Int. Cl.[3] ..... G10H 1/18; G10H 1/22; G10H 1/38

[52] U.S. Cl. ..... 84/1.01; 84/DIG. 2; 84/DIG. 22

[58] Field of Search ..... 84/1.01, 1.03, 1.17, 84/1.24, 445, 451, DIG. 2, DIG. 12, DIG. 22

[56] References Cited

U.S. PATENT DOCUMENTS

| | | | |
|---|---|---|---|
| 3,943,811 | 3/1976 | Coles | 84/1.01 |
| 3,986,422 | 10/1976 | Coles | 84/1.01 |
| 4,009,633 | 3/1977 | Coles | 84/1.01 |
| 4,048,893 | 9/1977 | Coles | 84/1.01 |
| 4,152,964 | 5/1979 | Waage | 84/1.01 |
| 4,176,573 | 12/1979 | Deutsch | 84/1.01 |
| 4,318,326 | 3/1982 | Howell | 84/1.01 |

*Primary Examiner*—S. J. Witkowski

*Attorney, Agent, or Firm*—Spensley, Horn, Jubas & Lubitz

[57] ABSTRACT

Tonality designation of an electronic keyboard instrument is realized by utilizing keys instead of conventional tonality designation switches provided on the panel of its.

The tonality designation system comprises a tonality data forming circuit and a memory. The tonality data forming circuit generates tonality data consisting of keynote data and scale data representative of key note and type of scale respectively based on key depression and transfers it to the memory in advance before performance. The memory stores the tonality designation data during performance. A musical tone to be produced is formed or controlled based on the stored tonality data and a depressed key.

19 Claims, 7 Drawing Figures

TO MUSICAL TONE FORMING CIRCUIT 5
LKI
TO MUSICAL TONE FORMING CIRCUIT 5
SD*
31
LATCH
LD
TD
21
214
LOW TONE PREFERENCE
M/mD
210
B
D
C#
C
41
DIF.
40
212
213
"1"
211
11
110
C7
B5
C4
B3
D3
C3#
C3
B2
D2
C2#
C2
"1"

LK1
TO MUSICAL TONE FORMING CIRCUIT 5
SDX
TO MUSICAL TONE FORMING CIRCUIT 5
32
LATCH
LD
22
TD
M/mD
43
DIF.
42
"1"
224
221
222
223
220
HIGH TONE PREFERENCE
11
110
C7
B6
C4
B3
D3
C3#
C3
B2
D2
C2#
C2
"1"

LKI
TO MUSICAL TONE FORMING CIRCUIT 5
SD*
TO MUSICAL TONE FORMING CIRCUIT 5
32
LATCH
LD
TD
M/mD
43
DIF.
23
232
CHORD DETECTING
230
B
D
C#
C
42
"1"
11
110
B6 C7
B3 C4
D3
C3#
C3
B2
D2
C2#
C2
"1"
231

LKI
TO MUSICAL TONE FORMING CIRCUIT 5
SD*
TO MUSICAL TONE FORMING CIRCUIT 5
32
LATCH
LD
TD
M/mD
43
DIF.
42
"1"
24
11
110
B6 C7
C4
B3 D3
C3* C3
B2
D2 C2*
C2
"1"
241
243
LD
LATCH
242
244
245
246
247

TO MUSICAL TONE FORMING CIRCUIT 5
TO MUSICAL TONE FORMING CIRCUIT 5
LK1
PK1
SD*
32
LATCH
LD
M/mD
TP
25
251
HIGH TONE PREFERENCE
250
NOTE NAME COMMONIZA-TION
252
PEDAL KEYBOARD DEPRESSED KEY DETECTION
253
43
DIF.
42
"1"
12
110
LOWER KEYBOARD KEY SWITCH GROUP
120
PEDAL KEYBOARD KEY SWITCH GROUP

TO MUSICAL TONE FORMING CIRCUIT 5
LK1
TO MUSICAL TONE FORMING CIRCUIT 5
SD*
LATCH
LD
32
33
43
DIF.
42
"1"
TD
M/mD
26
224
221
222
223
220
HIGH TONE PREFERENCE
260
261
11
110
C7
B6
C4
B3
D3
C3
C#3
B2
D2
C#2
C2
"1"

ELECTRONIC MUSICAL INSTRUMENT EMPLOYING KEYBOARD TONALITY DESIGNATION SYSTEM

BACKGROUND OF THE INVENTION

1. Field of the Invention

This invention relates to an electronic musical instrument provided with a tonality designation device, and in particular, to an electronic musical instrument in which the tonality designation is performed based on key depression in a keyboard of the instrument.

2. Prior Art

Musical tone producing methods in prior art electronic musical instruments having a tonality designation device are generally classified to: (1) a method in which with a tonality having been designated in advance, chords and bass tones related to the designated tonality and melody tones are formed by the performance of the melody tones, and these chords and bass tones are produced together with the melody tones (for example, as disclosed in the U.S. Pat. No. 3,986,424 to Sakashita, issued on Oct. 19, 1976), (2) a method in which with the tonality having been designated in advance, second melody tones related to designated tonality and first melody tones are formed by the performance of the first melody tones performed in monotones, and the second melody tones are produced together with the first melody tones (for example, as disclosed in the U.S. Pat. No. 4,205,576 to Deutsch et al., issued on June 3, 1980) and (3) a method in which information indicating the progress of chords memorized in advance according to a designated tonality and the progress of the automatic rhythm performance is read out, chords and bass tones are formed based on the information, and these tones are sequentially produced (for example, pending U.S. Pat. application Ser. No. 161,582 now U.S. Pat. No. 4,327,622).

Each of the above-mentioned electronic musical instruments has a tonality designation switch corresponding to each tonality, and a tonality to be performed is designated by turning on one of these tonality designation switches. These tonality designation switches are provided on the operation (control) panel of the electronic musical instrument. Since many switches for selecting a variety of functions are arranged on the operation panel, the addition of the tonality designation switches lowers operatability of the musical instrument to a great extent. Further, due to the considerably large number of these switches, which is as many as the number of tonalities, are required, a high cost is resulted unavoidably.

SUMMARY OF THE INVENTION

Accordingly, it is an object of this invention to provide a tonality designation system of an electronic musical instrument wherein the tonality designation can be made without providing many additional switches.

It is another object of this invention to provide a tonality designation system of an electronic musical instrument wherein a memory is provided for storing tonality data comprising keynote data representative of keynote of tonality and scale data representative of type of scale, in the tonality designation a tonality data is formed based on key data produced by a key depression in the keyboard, the tonality data being stored in the memory, and performance tones (i.e. tones to be performed) are formed or controlled based on the tonality data thus stored in the memory.

It is a further object of this invention to provide a tonality designation system of an electronic musical instrument wherein the tonality designation is made utilizing a keyboard, whereby providing switches corresponding to individual tonalities for the tonality designation other than the keyboard is not required.

It is still a further object of this invention to provide a tonality designation system of an electronic musical instrument wherein keynote of a tonality is designated based on key depression in a keyboard, more particularly, according to the note name of a depressed key.

The detail of the invention will be described with reference to accompanying drawings.

BRIEF DESCRIPTION OF THE DRAWINGS

In the accompanying drawings

DETAILED DESCRIPTION OF THE DRAWINGS

Figure 1:
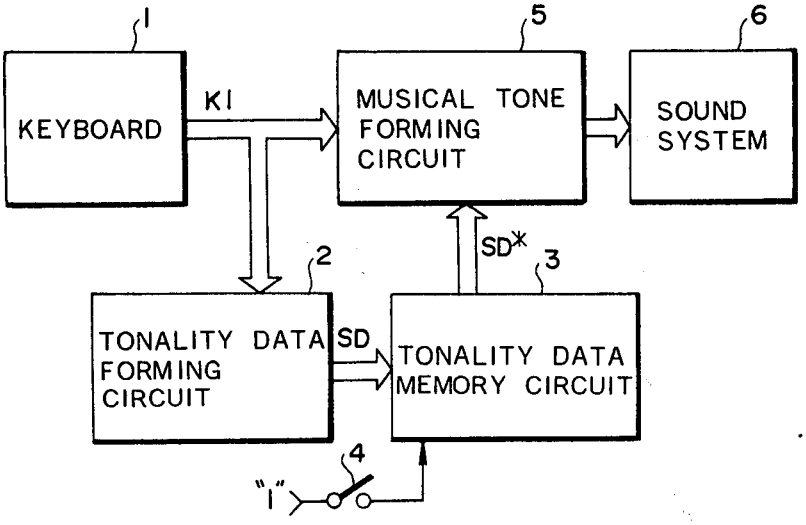
FIG. 1 is a schematic block diagram of an electronic musical instrument of this invention.

Referring to FIG. 1, an electronic musical instrument consists of a keyboard 1, a tonality data forming circuit 2 which forms the tonality data according to key depression in the keyboard 1, a tonality data memory circuit 3 which stores the tonality data formed in the tonality data forming circuit 2, a switch 4 for controlling the loading operation of the tonality data memory circuit 3, a musical tone forming circuit 5 for forming musical tone signals based on the key depression in the keyboard 1 and the tonality data stored in the tonality data memory circuit 3, and a sound system 6 for producing musical sounds based on the musical tone signals generated in the musical tone forming circuit 5. In this musical instrument the performance tonality (tonality to be performed) is designated based on the depressed key in the keyboard 1. For designating the performance tonality, a key or keys corresponding to the performance tonality is depressed in the keyboard 1. The keyboard 1 generates key information KI representing the depressed key in response to the key depression, and applies it to the tonality data forming circuit 2. The tonality data forming circuit 2 generates a tonality data SD for designating the performance tonality according to the key information KI. The detail of key depression in keyboard 1 in the tonality designation and the tonality data forming circuit 2 will be described later. The tonality data SD generated in the tonality data forming circuit 2 is loaded to the tonality memory circuit 3 synchronized with the turning-on of the switch 4, and is used for the control of the tonality of melody to be performed.

In the meantime, the key information KI representing the depressed key in the keyboard 1 is applied to the musical tone forming circuit 5. The musical tone forming circuit 5 generates a musical tone signal corresponding to a tone to be produced based on the key information KI and the tonality data SD* stored in the tonality data memory circuit 3. The musical tone signal thus generated in the musical tone forming circuit 5 includes not only the musical tone signal corresponding to the depressed key in the keyboard 1 but also musical tone signals corresponding to other keys relating to the depressed key in the keyboard 1. That is, the musical tone forming circuit 5 has a first circuit in which a first musical tone signal is formed corresponding to the depressed key in the keyboard on the key information KI from the keyboard 1, and a second circuit wherein second musical tone signals are formed corresponding to other keys relating to the depressed key in the keyboard 1 based on the key information KI from the keyboard 1. The tonality data SD* stored in the tonality data memory circuit 3 is used in the second circuit. For example, if the musical tone forming circuit 5 forms a musical tone signal corresponding to the depressed key in the keyboard 1 as well as a musical tone signal representing a chord relating to the tone of the depressed key, the musical tone forming circuit 5 will form, based on the depressed key, a plurality of musical tone signals representing chord component tones relating to the tone of the depressed key in addition to the musical tone signal corresponding to the depressed key. The Tonality data SD* is used in the formation of the plurality of musical tone signals. The musical tone forming circuit 5 is not necessarily limited to the circuit for forming musical tone signals corresponding to above-mentioned chords. It may be a circuit for forming musical tone signals corresponding to base tones. Further, it is not necessarily the one which consists of the above-described first and second circuits but one wherein a tone corresponding to the depressed key in the keyboard 1 is changed into a transposed or modulated tone corresponding to a tonality designated by the tonality data SD*, and a musical tone signal corresponding to the transposed or modulated tone is generated. Various uses of the tonality data SD* in the musical tone forming circuit 5 may be conceived including one that has been mentioned in conjunction with the prior art. The musical tone forming circuit 5 may be composed any of these circuits.

The tonality designation which is the main part of this invention will now be described.

FIGS. 2 through 7 show detailed circuit diagrams of circuits relating to the tonality designation of different embodiments. These circuits correspond to a part of the keyboard 1, the tonality data forming circuit 2, and the tonality data memory circuit 3 in the block diagram of FIG. 1. In the circuit diagrams of FIGS. 2 through 7, the same reference numbers and symbols are assigned to the portions performing similar functions.

Figure 2:
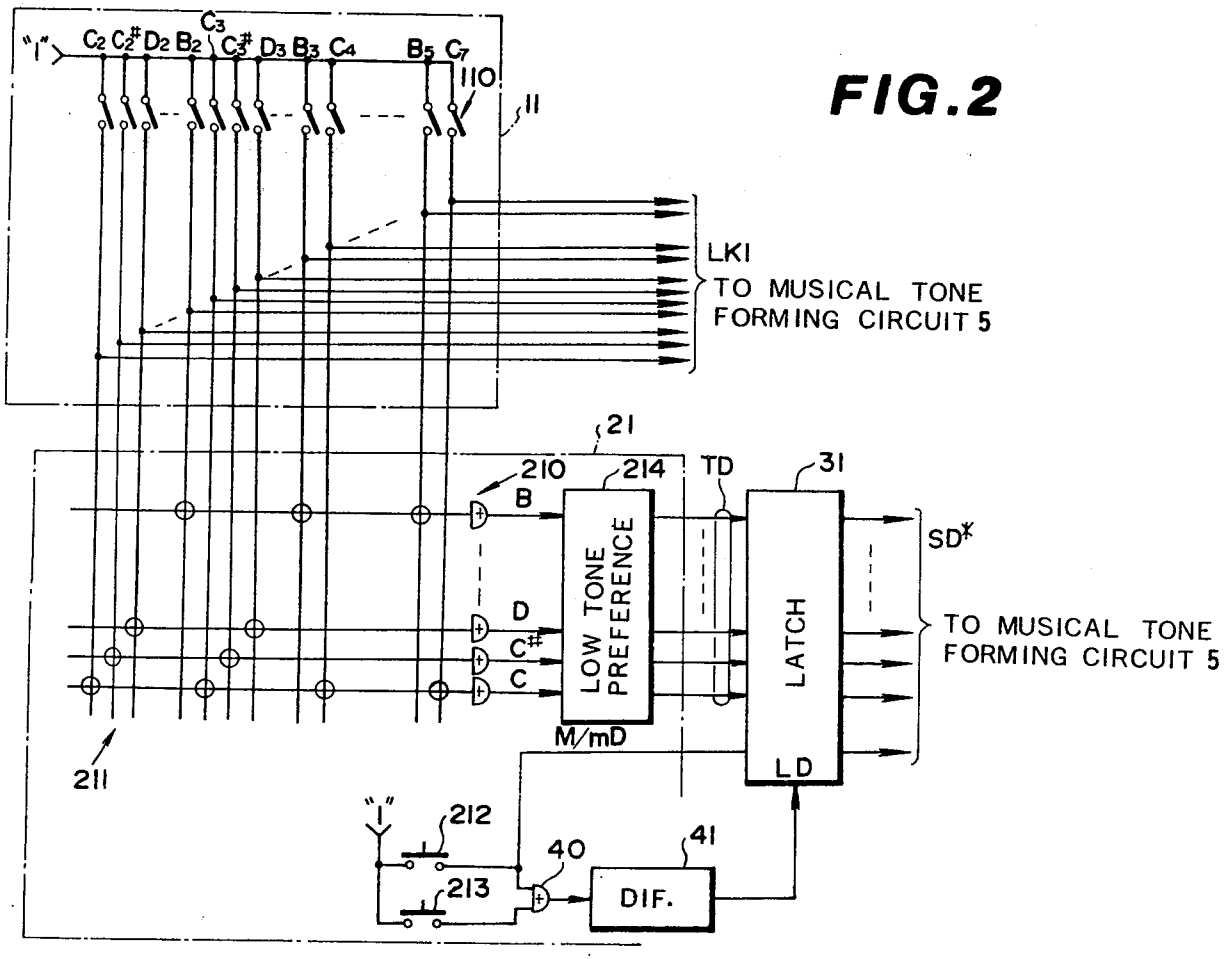
FIGS. 2 through 7 are circuit diagrams showing various embodiments of main parts of the electronic musical instrument in FIG. 1.

In an embodiment shown in FIG. 2, the tonality designation is performed by the depression of a key in the lower keyboard of the keyboard 1 corresponding to the keynote of a tonality to be designated together with the operation of a major designation switch 212 or a minor designation switch 213 with the key being depressed. A lower keyboard depressed key detection circuit 11 is provided with a key switch group 110 which comprises key switches corresponding to the keys of the lower keyboard, the output of each key switch being sent to the musical tone forming circuit 5, and also being applied to a tonality data forming circuit 21, as key information LKI. The tonality data forming circuit 21 is provided with a note name commonization circuit 211 consisting of a OR circuit group 210 having 12 OR circuits corresponding to 12 note names, a low tone preference circuit 214 which selectively outputs the lowest tone output of the OR circuit group 210 from among tones being produced as well as a major designation switch 212 and a minor designation switch 213.

Assume that a certain key of the lower keyboard is depressed. Then, a signal "1" is generated at an OR circuit corresponding to the note name of the depressed key of the OR circuit group 210 of the note name commonization circuit 211, and this signal "1" is fed to a latch circuit 31 via the low tone preference circuit 214 as a keynote data TD which designates the keynote of the tone. This keynote data TD corresponds to the lowest note name of note name of depressed keys in the lower keyboard.

The output of the major designation switch 212 is fed to the latch circuit 31 as a major/minor data M/mD. As the major designation switch 212 is turned on, this major/minor data M/mD becomes "1", while when the switch 212 is turned off, it becomes "0". The value "1" designates major, while "0" designates minor. The major designation switch 212 and the minor designation switch 213 are mechanically interlocked so as not to become ON concurrently.

The outputs of the major designation switch 212 and the minor designation switch 213 are fed to a differential circuit 41 via an OR circuit 40. The output of the OR circuit 40 is differentiated at the leading edge at the differential circuit 41, and is fed to a load control input terminal LD of the latch circuit 31. Accordingly, when the key of the note name corresponding to the keynote of the tone to be designated is depressed in the lower keyboard, and either the major designation switch 212 or the minor designation switch 213 is turned on with the key kept depressed, the latch circuit 31 latches the keynote data TD representing the keynote of the scale and the major/minor data M/mD indicating major/minor scale.

The keynote data TD and major/minor data M/mD thus latched at the latch circuit 31 is sent out to the musical tone forming circuit 5 (FIG. 1) as a tonality data SD*.

Figure 3:
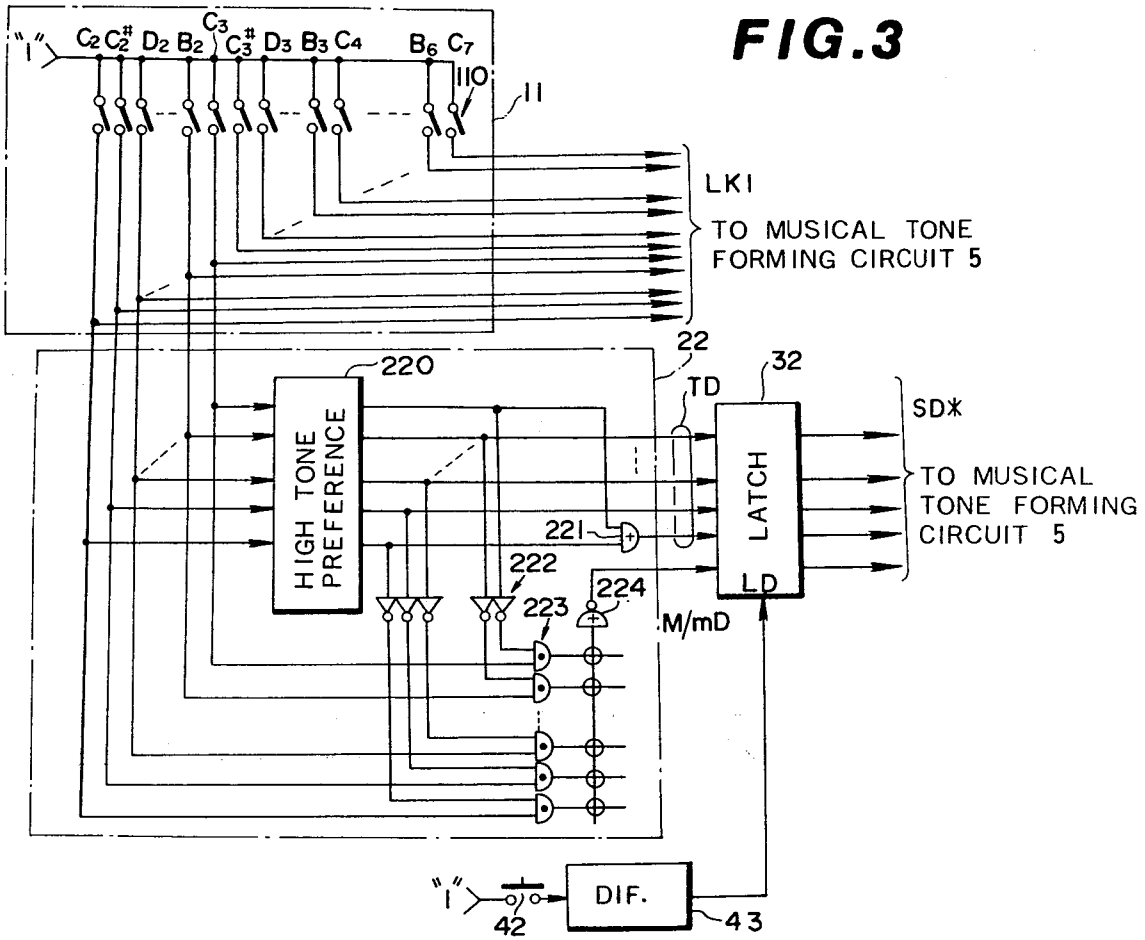

In another embodiment shown in FIG. 3, the keynote of a scale and either major or minor are designated based on the depressed key in a certain key part of the lower keyboard (in this example, the key part ranging from the tone C2 to C3). That is, the keynote data TD is formed according to the note name of the highest note corresponding to the keys depressed at a certain key part of the lower keyboard, and the major/minor data M/mD is formed according to the number of keys depressed in the certain key part of the lower keyboard.

The output of the key switch group 110 of the lower keyboard depressed key detection circuit 11 is sent out to the musical tone forming circuit 5 as the lower keyboard key information LKI, and the outputs of the key switches corresponding to form the tone C2 to C3 which belong to the key switch group 110 are fed to a high tone preference circuit 220 of the tonality data forming circuit 22. The high tone preference circuit 220 selects the output corresponding to the highest tone out of all outputs of key switches corresponding to the tone C2 to C3 which are "1", and outputs the selected one. For example, assume that keys corresponding to the tone C2 and D2 are depressed in the lower keyboard. Then, the high tone preference circuit 220 generates a signal "1" in only the line corresponding to the tone D2. The output of the high tone preference circuit 220 is fed to a latch circuit 32 as a keynote data TD. In this case, the signal relating to the tone C is twofold: one corresponding to the tone C2 and the other corresponding to the tone C3. These two are consolidated at an OR circuit 221, and the resulting signal is fed to the latch circuit 32.

The output of the high tone preference circuit 220 is inverted at each inverter of an inverter group 222, and is fed to each AND circuit of an AND circuit group 223. To the other input of each AND circuit is fed the output of a key switch corresponding to the tone C2 to C3. Accordingly, when the number of keys being depressed in the key part ranging from the tone C2 to C3 in the lower keyboard is one, all become inoperative, while when the number of keys being depressed is multiple, some become operatable. For example, when the number of keys being depressed in the key part ranging from the tone C2 to C3 in the lower keyboard is one, the output corresponding to the depressed key of all outputs of key switches corresponding to the tone C2 to C3 becomes "1", and this signal is directly selected by the high tone preference circuit 220, and is output. Accordingly the AND circuit corresponding to the depressed key is made inoperative by the signal inverted at the corresponding inverter of the inverter group 223, and other AND circuits of the AND circuit group 223 are made inoperative by the output of the key switches. As a result, all AND circuits of the AND circuit group 223 become inoperative. On the other hand, when the number of keys depressed in the key part ranging from the tone C2 to C3 in the lower keyboard is multiple, the signal to be selected at the high tone preference circuit 220 is one that corresponds to a single key of all depressed keys, and AND circuits of the AND circuit group 223 corresponding to the depressed keys not selected by the high tone preference circuit 220 become operatable.

The outputs of AND circuits of the AND circuit group 223 are fed to a NOR circuit 224, and are processed according to the NOR condition. Accordingly, when the number of keys depressed in the key part ranging from the tone C2 to C3 in the lower keyboard is one, a signal "1" indicating major is generated, while when it is multiple, a signal "0" indicating minor is generated. The output of this NOR circuit 224 is fed to the latch circuit 32 as a major/minor data M/mD.

The latch circuit 32 receives at a load control input LD thereof, a pulse resulted from the differentiation of the output of a load switch 42 at its leading edge, and latches the keynote data TD and the major/minor data M/mD applied synchronized with the turning on of the load switch 42.

That is, when one or more keys are depressed in the key part ranging the tone C2 to C3 in the lower keyboard, and the load switch 42 is turned on with the above key or keys being depressed, the signal representing the highest note of the depressed keys in the key part is latched as the keynote data TD at the latch circuit 32. When the number of the depressed keys in the key part is one, the signal indicating major is latched as the major/minor data M/mD at the latch circuit 32. When a plural number of keys are depressed in the key part, the signal indicating minor is latched at the latch circuit 32 as the major/minor data M/mD. The signal thus latched at the latch circuit 32 is sent out to the musical tone forming circuit 5 as the tonality data SD* designating the performance tonality.

Figure 4:
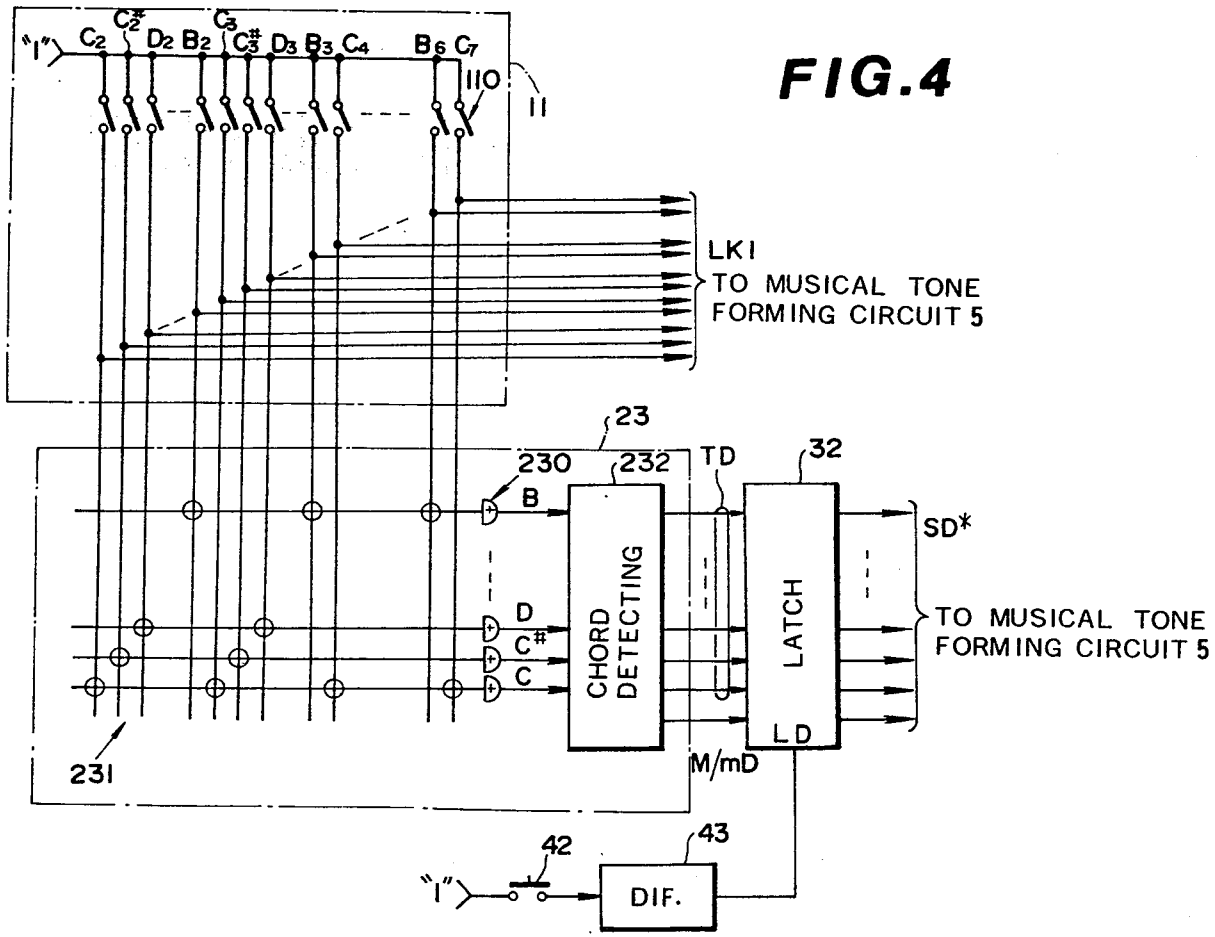

Referring to FIG. 4, which shows another embodiment, when keys are depressed in the chord mode in the lower keyboard, and the load switch 42 is turned on with these keys being depressed, the keynote of the tonality is designated based on the root of the chords comprising the sound of the depressed keys in the lower keyboard, and either major or minor is designated according to the type of the chords.

The output of the key switch group 110 of the lower keyboard depressed key detection circuit 11 is fed to a note name commonization circuit 231 comprising a tonality data forming circuit 23 and an OR circuit group 230, converted to 12 signals representing 12 note names in general, which are not the note names of any particular octave note part, and fed to a chord detecting circuit 232. The chord detecting circuit 232 detects the root and type of the chord which is constituted with the tones of the depressed keys, based on the signals representing the tone names of the depressed keys in the lower keyboard to be output from the tone name commonization circuit 231. Any known chord detecting circuit may be used for this purpose. The chord detecting circuit 232 detects a signal representing the note name of the root of the chord as the keynote data TD, judges the type of the chord, i.e., major or minor, generates the major/minor data M/mD, i.e., signal "1" for major and "0" for minor, and applies these data to the latch circuit 32 which latches these signals synchronized with the operation of the load switch 42.

This is, when a plurality of keys are depressed in a chord mode in the lower keyboard and the load switch 42 is operated with the keys being depressed, the tonality designation is made according to the root and the type of the chord which is constituted with the tones of depressed keys in the lower keyboard.

Figure 5:
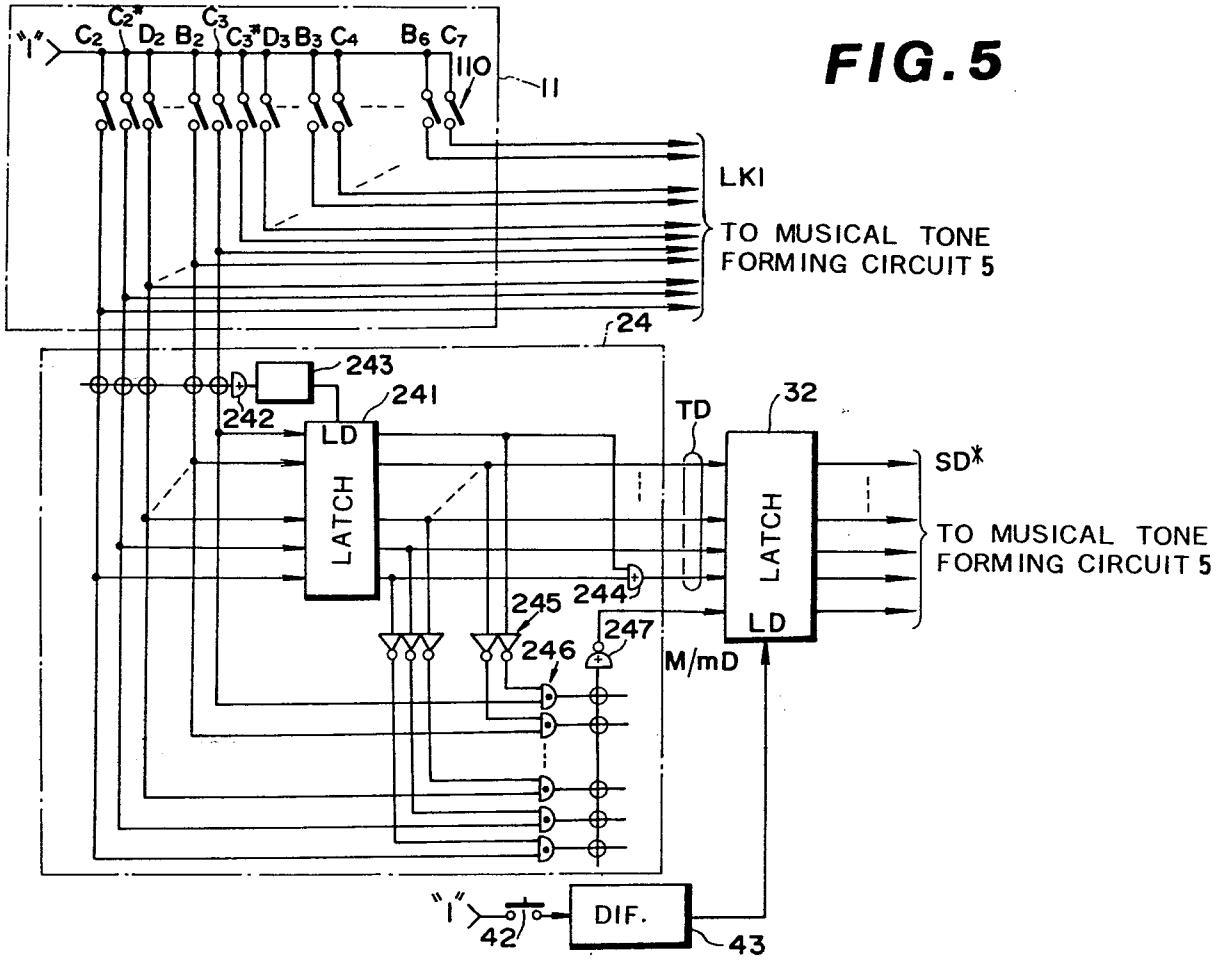

Referring to FIG. 5 which shows another embodiment, the tonality designation device is so arranged that the keynote of a tonality to be performed is designated by the depression of keys in a certain key part in the lower keyboard for the first time, and major or minor is designated depending on whether or not other keys in the same key part are depressed subsequently.

The outputs of key switches corresponding to the tone C2 to C3 in the key switch group 110 of the lower keyboard depressed key detection circuit 11 are fed to a latch circuit 241 of the tonality data forming circuit 24. The latch circuit 241 receives at its load control input terminal LD a signal resulted from the differentiation by a differentiation circuit 43 at the leading edge, of the output signal of an OR circuit 242, which receives the outputs of the key switches corresponding to the tone C2 to C3. Accordingly, the latch circuit 241 latches a signal corresponding to a key firstly depressed in the key part ranging the tone C2 to C3 in the lower keyboard. The signal thus latched at the latch circuit 241 is fed to the latch circuit 32 as a keytone data TD. A signal corresponding to the tone C3, however, is combined with the signal corresponding to the tone C2 via an OR circuit 244, and is fed to the latch circuit 32. The outputs of the latch circuit 241 are inverted at inverters of an inverter group 245, and fed to AND circuits of an AND circuit group 246 respectively. To the other input of each AND circuit of the AND circuit group 246 is fed the output of the key switches corresponding to the tone C2 to C3. Accordingly, when the number of keys depressed in the key part ranging the tone C2 to C3 is one, all AND circuits of the AND circuit group 246 become inoperative. When another key or keys are depressed subsequent to the depression of a single key in the key part, the AND circuit corresponding to the key depressed later becomes operatable, and outputs a signal "1". The outputs of AND circuit of the AND circuit group 246 are processed according to the NOR condition at a NOR circuit 247 and the output thereof is fed to the latch circuit 32 as the major/minor data M/mD. The latch circuit 32 latches the keytone data TD from the latch circuit 241 and the major/minor data M/mD from the NOR circuit 247 synchronized with the operation of the load switch 42, and the tonality designation process is completed. When a single key is depressed in the key part ranging the tone C2 to C3 in the lower keyboard, and the load switch 42 is operated with the single key being depressed, the tonality of major having the keynote represented by the note name of the depressed key in the above key part is designated. On the other hand, when a single key is depressed in the key part ranging the tone C2 to C3 in the lower keyboard, then a key or keys is depressed with the single key being depressed, and the load switch 42 is operated, the tonality of minor having the keynote represented by the note name of the first depressed key in said key part is designated.

Figure 6:
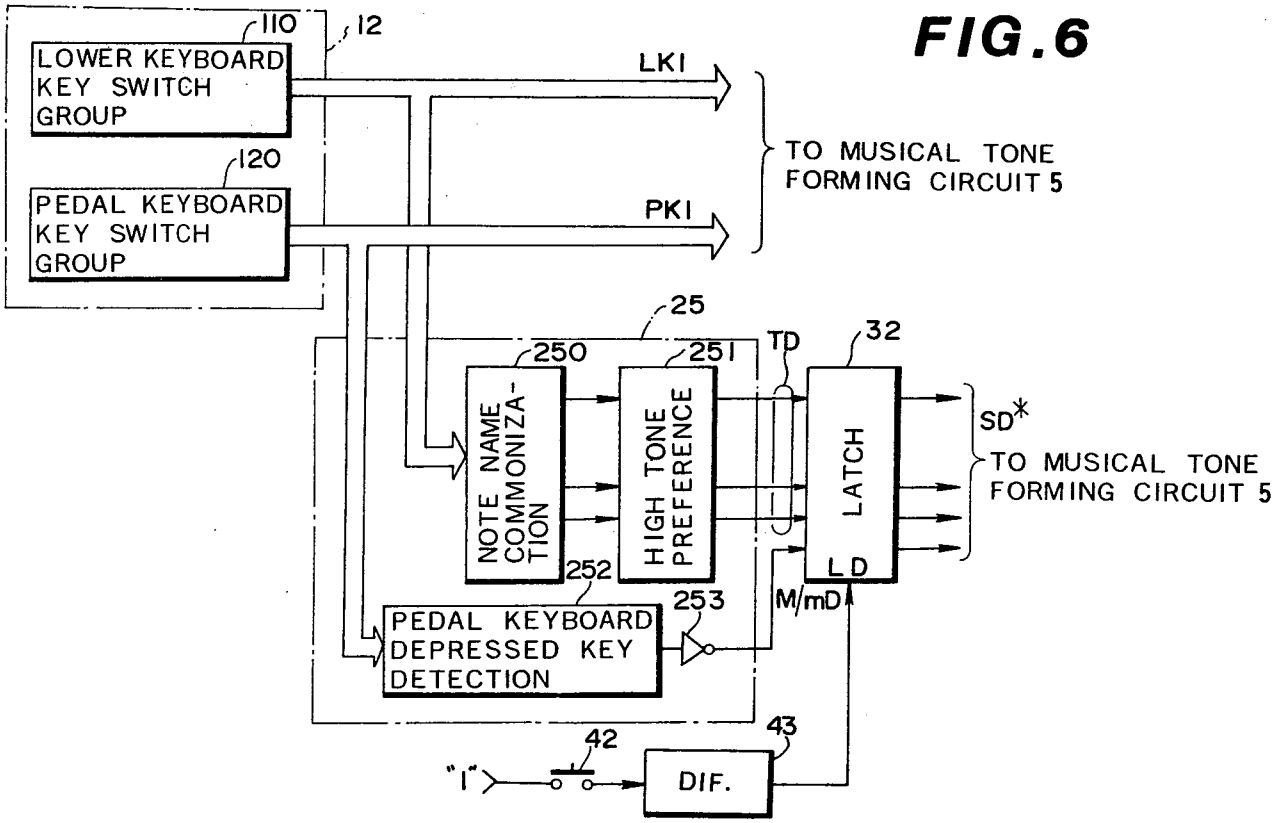

Referring to FIG. 6 which shows another embodiment, keynote and type of scale (i.e., major or minor) is designated using two keyboards (the lower keyboard and pedal keyboard). The keynote is designated according to the tone name of the key corresponding to the lowest note of all depressed keys in the lower keyboard, and major or minor is designated according to whether or not any key is depressed in the pedal keyboard.

A depressed key detecting circuit 12 is provided with a lower keyboard key switch group 110 consisting of key switches corresponding to individual keys of the lower keyboard and a pedal keyboard key switch group 120 consisting of key switches corresponding to individual keys of the pedal keyboard. The outputs of the lower keyboard key switch group 110 and the pedal keyboard key switch group 120 are sent out to a musical tone forming circuit 5 as a lower keyboard key information LKI and a pedal keyboard key information PKI, both representing depressed keys, and are fed to a tonality data forming circuit 25. The tonality data forming circuit 25 applies the output of the lower keyboard key switch group 110 to a note name commonization circuit 250, converts it to 12 general note name signals which are not the note names of any particular octave note part, applies these signals to a low note preference circuit 251, selects a signal representing the lowest note name at said circuit 251, and applies the selected signal to the latch circuit 32 as a keynote data TD for designating the keynote of the tonality. Furthermore, the tonality data forming circuit 25 applies the output of the pedal keyboard key switch group 120 to a pedal keyboard depressed key detection circuit 252. The pedal keyboard depressed key detection circuit 252 is for detecting whether or not any key of the pedal keyboard is depressed. The circuit 252 generates a signal "1" if any key of the pedal keyboard is depressed, and a signal "0" if none is depressed. The circuit 252 may be constituted by an OR circuit which operates according to the OR condition of the outputs of all key switches of the pedal keyboard key switch group 120. The output of the circuit 252 is inverted at an inverter 253, and fed to the latch circuit 32 as the major/minor data M/mD representing major or minor.

Accordingly, if the load switch 42 is actuated in this state, a pulse is generated at the differentiation circuit 43 being differentiated at the leading edge, the keynote data TD from the low note preference circuit 251, and the major/minor data M/mD from the inverter 253 are latched at the latch circuit 32 by the pulse, and the tonality designation is made.

In this embodiment, arrangement may be made so that when a white key of the pedal keyboard is depressed a major is designated, while when a black key is depressed a minor is designated. In this case, the pedal keyboard depressed key detection circuit 252 should be designed so that when a white key is depressed in the pedal keyboard a signal "1" is generated, while when a black key is depressed a signal "0" is generated, and that the output of the circuit 252 is directly applied to the latch circuit 32.

Figure 7:
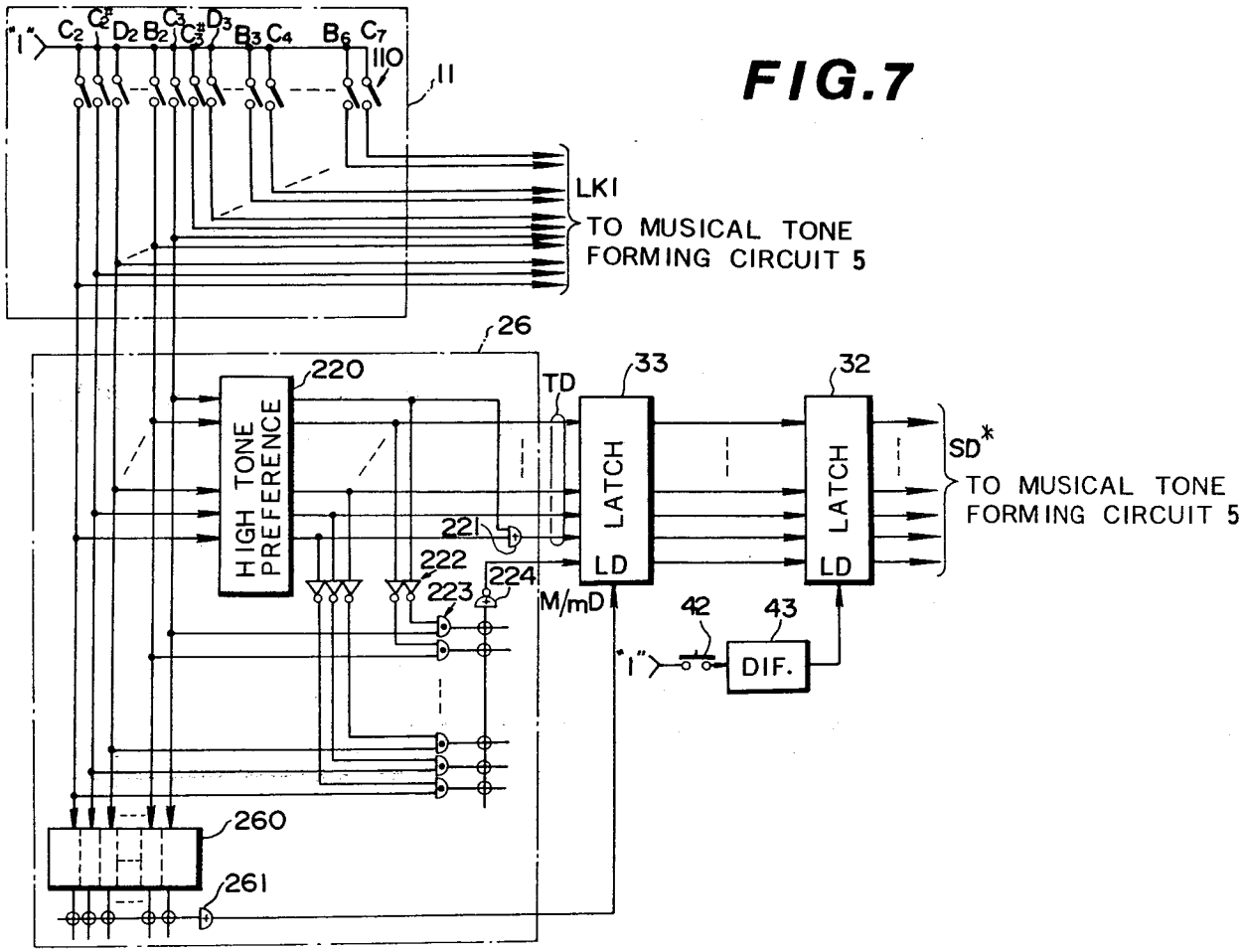

It should be noted, however, that for designating the tonality in the embodiments shown in FIGS. 2 through 6, the load switch (212, 213, 42) should be operated with the key being depressed. Operating the load switch with the key being depressed is not always desirable in the aspect of operatability. Thus, FIG. 7 shows an embodiment in which a plural stage memory circuit is provided, and the tonality can be designated based on the key which had once been depressed before the key release, even if the load switch is depressed after the key release. This embodiment is constituted based on the embodiment shown in FIG. 3, and the same reference numerals and symbols are assigned to the same part of FIG. 3 for the sake of simplification of description. This idea is applicable to all embodiments shown in FIGS. 2 through 6.

Referring to FIG. 7, a latch circuit 33 is provided in addition to the latch circuit 32 shown in FIG. 3. To the load control input terminal LD of the latch circuit 33 is fed the output signal of an OR circuit 261 which receives the output of a differentiation circuit 260 that differentiates the output of each key switch corresponding to the tone C2 to C3 at its leading edge. Accordingly, the content of the latch circuit 33 is rewritten each time any key in the key part ranging the tone C2 to C3 is depressed in the lower keyboard, and the content (keynote data TD and major/minor data M/md) at the time when the last key depression has been made in the key part is eventually latched and retained at the latch circuit 33. The output of this latch circuit 33 is fed to the latch circuit 32. To the load control input terminal LD of the latch circuit 32 is fed a pulse resulted from the differentiation of the output of the load switch 42 at a differentiation circuit 43 at its leading edge. Upon receipt of the pulse by the latch circuit 32, the content of the latch circuit 33 is transferred to the latch circuit 32 synchronized with the actuation of the load switch 42, and latched at the latch circuit 32. The latch content of this latch circuit 32 is sent out to a musical tone forming circuit 5 as the tonality data SD*.

In such arrangement, the tonality designation is made based on depression of a key having once been depressed before key release in the keyboard for the tonality designation and by the operation of the load switch 42 after the release of the depressed key.

Although the keynote is designated by using the lower keyboard in the aforementioned embodiments, alternatives within the scope of the invention will occur to those skilled in the art. For example, the upper keyboard or the pedal keyboard may be used.

Major or minor may be designated by a predetermined key in the same keyboard as that used for the keynote designation. For example, the keynote of the tonality may be designated by key depression of the key corresponding to the tone C2 to B2 using the key part ranging the tone C2 to C3 in the lower keyboard, while major/minor may be designated according to whether or not the key corresponding to the tone C3 is depressed.

Alternatively, the keynote of the tonality may be designated by the note name of the depressed key in the keyboard, and the type of scale may be designated by the key part to which the depressed key belongs. For example, major is designated by the depression of keys corresponding to the tone C2 to B2 using the key part ranging from the tone C2 to B3, and minor is designated by the depression of keys corresponding to the tone C3 to B3.

Furthermore, although in the aforementioned embodiments, the description has been made limiting the type of scale to major and minor, i.e., the diatonic major scale and the minor scale, it is applicable to various other scales such as the whole tone scale, half tone scale, Japanese scale, etc. In such case, where the number of the type of scale becomes 3 or more, the scale type designation may be made easily through applying the techniques disclosed with reference to the aforementioned embodiments, in which the type of scale is designated by:

(1) A switch provided separately from keyboards.
(2) Based on the number of depressed keys in the keyboard.
(3) Based on the kind of chords which the notes of depressed keys in the keyboard constitute.
(4) Based on a depressed key in a key part or a keyboard different from a key part or a keyboard which is used in designation for keynote.
(5) Based on the key part of a depressed key in the keyboard.

For example in (4), such system is conceived that the keynote is designated by the note name of a depressed key in the key part ranging the tone C2 to B2 in the lower keyboard, and the type of scale is designated by a depressed key in the key part ranging the tone C3 to B3. In this case, a total of 12 types of scale can be designated corresponding to the tone C3 to B3.

What is claimed is:

1. A tonality designation system of an electronic musical instrument capable of designating tonality by means of a keyboard, comprising:

a keyboard having plurality of keys, a keynote data forming circuit for forming a key note data representative of a keynote of a tonality to be performed based on key depression of said keyboard, scale designating means for designating a type of scale and for outputting a scale data representative of the designated type of scale, and memory means for storing said keynote data and said scale data as data for specifying tonality.

2. A tonality designation system of an electronic musical instrument as defined in claim 1, wherein said scale designating means further has a memory loading function.

3. A tonality designation system as defined in claim 1 wherein said memory means stores said keynote data and said scale date in advance in performance.

4. A tonality designation system as defined in claim 3 further comprising means, operative during performance, for automatically providing musical tones, in addition to those corresponding to the performance, and having tonality established by the data stored in said memory means.

5. A tonality designation system of an electronic musical instrument capable of designating tonality by means of a keyboard, comprising:

a keyboard having a plurality of keys, a tonality data forming circuit for forming a keynote data representative of a keynote of a tonality to be performed and a scale data representative of a type of a scale based on key depression of said keyboard, and memory means for storing said keynote and said scale data as data for specifying tonality.

6. A tonality designation system of an electronic musical instrument as defined in claim 5 further comprising loading means.

7. A tonality designation system as defined in claim 5 wherein said memory means stores said keynote data and said scale date in advance of performance.

8. A tonality designation system of an electronic musical instrument as defined in claim 7, wherein said tonality data forming circuit comprises a chord detecting circuit which detects the root of a chord in order to form said keynote data, and chord type of said chord in order to form said scale data, said chord being produced by said key depression for designation of tonality in said keyboard.

9. An electronic musical instrument comprising:

a keyboard having a plurality of keys and including means for generating key information representative of the depressed key or keys on the keyboard;

keynote data forming means for forming keynote data representative of tonality from said key information;

scale designating means for designating a type of scale and for outputting scale data representative of said designated type of scale;

load instructing means for instructing the generation of a load signal manually;

memory means for receiving and storing said keynote data and said scale data in response to said load signal;

modifying means for modifying said key information for performance in accordance with said stored keynote data and said stored scale data, and for outputting modified key information; and tone producing means for producing tones corresponding to said key information and said modified key information.

10. An electronic musical instrument as defined in claim 9, wherein said keynote data forming circuit outputs, as said keynote data, a note name of the highest or lowest note among said depressed key or keys for designation of tonality.

11. An electronic musical instrument as defined in claim 10 wherein said scale designating means comprises a switch for designating said type of scale.

12. An electronic musical instrument comprising:

a keyboard having a plurality of keys and including means for generating key information representative of the depressed key or keys on the keyboard;

tonality data forming means for forming tonality data representative of a tonality in accordance with the depressed key or keys for designation of said tonality, said tonality data comprising keynote data representative of a keynote of said tonality and scale data representative of a type of scale of said tonality;

load instructing means for instructing the generation of a load signal manually;

memory means for receiving and storing said tonality data in response to said generation of the load signal;

modifying means for modifying said key information for performance in accordance with said stored tonality data and outputting modified key information; and tone producing means for producing tones corresponding to said key information and said modified key information.

13. An electronic musical instrument as defined in claim 12, wherein said tonality data forming circuit comprises:

a keynote data forming circuit for forming said keynote data, and scale data forming means for forming said scale data.

14. An electronic musical instrument as defined in claim 13 wherein said scale data forming circuit forms said scale data in accordance with the number of said depressed key or keys for designation of tonality.

15. An electronic musical instrument as defined in claim 13, wherein said keynote data forming circuit outputs said keynote data representative of a note name of the highest or lowest note among said depressed key or keys for designation of tonality.

16. An electronic musical instrument as defined in claim 13, wherein said keynote data forming circuit is a keynote memory circuit for storing, as said keynote data, note name of a note produced by the first depression of a key for designation of tonality, and said scale data forming circuit forms said scale data in accordance with the presence or absence of the subsequent key depression for designation of tonality.

17. An electronic musical instrument as defined in claim 13, wherein said keyboard comprises a first keyboard and a second keyboard, said keynote data forming circuit is connected to said first keyboard for forming said keynote data based on key depression for designation of tonality of said first keyboard, and said scale data forming circuit is connected to said second keyboard for forming said scale data in accordance with key depression for designation of tonality of said second keyboard.

18. An electronic musical instrument as defined in claim 12, wherein said tonality data forming circuit comprises a chord detecting circuit which detects the root of a chord in order to form said keynote data, and chord type of said chord in order to form said scale data, said chord being produced by said key depression for designation of tonality in said keyboard.

19. A tonality designation system of an electronic musical instrument as defined in claim 12, wherein said memory means comprises a first memory and a second memory mutually connected in cascade, said first memory being for storing said keynote data and said scale data based on said key depression for designation of tonality, and said second memory being for receiving and storing said keynote data and said scale data stored in said first memory in response to said load instructing signal as data for specifying tonality.

* * * * *